United States Patent [19]

Humphrey

[11] Patent Number: 4,590,746

[45] Date of Patent: May 27, 1986

[54] CONSTANT TENSION STRETCH WRAPPING MACHINE

[75] Inventor: John R. Humphrey, Naples, Fla.

[73] Assignee: International Packaging Machines, Inc., Naples, Fla.

[21] Appl. No.: 374,741

[22] Filed: May 4, 1982

Related U.S. Application Data

[63] Continuation-in-part of Ser. No. 307,283, Sep. 30, 1981, abandoned.

[51] Int. Cl.[4] ..... B65B 11/04

[52] U.S. Cl. ..... 53/556; 53/587; 53/389; 242/75.53

[58] Field of Search ..... 53/399, 441, 556, 587, 53/389; 242/7.13, 75.51, 75.53

[56] References Cited

U.S. PATENT DOCUMENTS

| | | | |
|---|---|---|---|
| 852,337 | 4/1907 | Marks | 100/13 |
| 2,285,654 | 6/1942 | Hanna | 242/7.13 X |
| 2,544,467 | 3/1951 | Michel | 242/75.51 |
| 4,095,318 | 6/1978 | Abbott | 53/556 |
| 4,387,548 | 6/1983 | Lancaster | 53/399 |
| 4,413,463 | 11/1983 | Lancaster | 53/556 X |
| 4,418,510 | 12/1983 | Lancaster | 53/399 |
| 4,458,467 | 7/1984 | Shulman | 53/587 |
| 4,514,955 | 5/1985 | Mouser | 53/587 |

FOREIGN PATENT DOCUMENTS

| | | | |
|---|---|---|---|
| 544917 | 8/1957 | Canada | 53/587 |
| 2455331 | 5/1976 | Fed. Rep. of Germany | 53/587 |
| 2750780 | 5/1979 | Fed. Rep. of Germany | 53/556 |
| 2948694 | 6/1981 | Fed. Rep. of Germany | 53/556 |
| 2281275 | 8/1974 | France | 53/556 |

*Primary Examiner*—John Sipos

*Attorney, Agent, or Firm*—Antonelli, Terry & Wands

[57] ABSTRACT

A wrapping machine and operation for wrapping a load arranged on a pallet with a stretchable wrapping material under a substantially constant tension during the wrapping operation. The load that is to be wrapped is arranged on a support member which can be rotated for drawing off stretchable wrapping material from a roll of such material. A dispensing mechanism holds the roll of stretchable wrapping material and dispenses the material so that it can be wrapped around the load arranged on the support member. As an alternative to the support member with the load being rotated, the dispensing member can revolve around the support member and the load so as to dispense and wrap the load with the stretchable material. During the wrapping operation, the tension on the portion of the stretchable wrapping material being wrapped around the load is maintained at a substantially constant tension. Prior to actually wrapping the load with the stretchable wrapping material, such material can be prestretched. The prestretching operation occurs at a location between the dispensing mechanism and the location at which the stretchable material is actually supplied to the load for wrapping.

9 Claims, 11 Drawing Figures

CONSTANT TENSION STRETCH WRAPPING MACHINE

CROSS REFERENCE TO RELATED APPLICATIONS

This application is a continuation-in-part of application Ser. No. 307,283, which was filed on Sept. 30, 1981, now abandoned.

BACKGROUND OF THE INVENTION

1. Field of the Invention

The present invention relates to equipment and a process for wrapping a pallet load with a stretchable wrapping material in such a manner so as to achieve the tightest wrap possible without damaging the load being wrapped.

2. Description of the Prior Art

United Kingdom Pat. No. 2,059,906 discloses a stretch wrapping machine and process. An accumulator having a dancer roller which contacts the moving film, compensates for variations in speed at which the film is drawn into the object being wrapped. The dancer roller is biased against the moving film by a constant force producing element.

Several different types of stretch wrapping machines are illustrated in U.S. Pat. Nos. 4,050,221; 4,077,179; and 4,079,565, all to Lancaster et al. Other stretch wrapping machines are shown in U.S. Patent Applications Ser. No. 72,471, filed Sept. 4, 1979 to Humphrey, and Ser. No. 235,946, filed Feb. 19, 1981 to Humphrey et al, both of which are assigned to the same assignee as the present application. The subject matter of both of these applications is hereby incorporated by reference. Stretch wrapping a pallet load may be compared to stretching a rubber band around a group of objects. Presuming that there is a uniformly-shaped pallet load that has been stretch wrapped with a stretchable wrapping film tensioned to a 10 pound pull and that there are three wraps, i.e. the load has been wrapped three times around the load, then the force holding the load together are 30 pounds in both directions at each corner. At the center points of each side of the load there is no direct inward holding force although the products in the center of the load are clamped together by the adjacent outer products. There is also a diagonal force which is the resultant of the two directional forces on each corner of the load.

It must be recognized that all wrapping films relax with the result that the rubber band effect or holding power is diminished with the passing of time. The amount of tension required for a particular load must be sufficient to contain the integrity of the load which may settle, change shape or shift in transit or during storage. A shifting load alternately stretches and relaxes the film; each time the film is stretched further, the recovery tension is reduced. Enough initial tension must be applied to the load to compensate for these subsequent.

If the extent to which the wrapping material is stretched is too great, then this will diminish its holding power. Most films produce their greatest holding force or tension when stretched during the wrapping operation between approximately 20% to 35%. If a film is stretched beyond its elastic limit, which is the point where permanent deformation occurs, the film thins out in gauge and its ability to recover and hold the load will decrease, perhaps drastically and perhaps even destroyed. For example, a wrapping film with a maximum holding power of 30 pounds when stretched to 30% stretch may have only 15 to 17 pounds holding power if stretched over 100%. If the resulting weaker film is adequate to hold the load securely then economies will result by using less film per pallet load. Otherwise, additional wraps will be required to obtain the same holding force as can be obtained by fewer of the same film stretched only 20% to 35%.

As indicated above, all stretch films relax to some extent, in varying degrees, after the load is wrapped. In addition, the wrapping films which have been stretched or prestretched more than 100% will tend to relax more than films which are stretched 20% to 35% during the wrapping process. The objective in wrapping a load with a stretchable wrapping material is to obtain the tightest wrap possible without damaging or causing collapse of the load.

The concept of prestretching the stretchable wrapping material before wrapping a load has recently emerged and has been incorporated in several commercial machines. Employing a film prestretching device makes the film longer and thinner while simultaneously increasing the yield and decreasing the load holding power or strength of the film. Since various loads, however, may need to be wrapped with film having different holding powers, prestretching enables a single type of film to be used in wrapping a plurality of different types of loads with the film then being prestretched to the extent necessary.

Whether or not a prestretching device is used, however, the film must still be stretched by applying tension on the film as it is applied to the load. This tension, which results from the load pulling the film against some restraining device during the wrapping operation, is normally necessary since it causes the stretching that provides the holding power to hold the load together. Prestretching is a separate and isolated function from stretch wrapping of the load. Whether film prestretching is done on the wrapping machine or in the film manufacturers plant, the film normally must still be further stretched during the wrapping operation.

The currently available commercial prestretching devices normally consist of two rubber-covered rollers which are rotated at different speeds. The speed differential is created by appropriate gears, belt drives, separate D.C. variable speed motors, separate brakes or other similar types of mechanisms. While some of the prestretching devices are powered by the load pulling the film, most of the devices are motor powered.

In the operation of the pre-stretching devices, the film passes over both rollers with the second roller rotating at a faster speed than the first roller thereby providing a stretching action on the film. If the second roller rotates twice as fast as the first, assuming there is no slippage and a minimum "necking down" of the film, the film will be stretched approximately 100%. Various speed ratios of the rollers will produce proportional percentage stretch in the film. For example, a relatively heavy gauge film (#90) may theoretically be doubled in yield (length) to wrap light loads with light tension. The original holding power of such film was 30 pounds but with 100% pre-stretching the gauge changes to #45 and the holding power is approximately 16 pounds, which is adequate for light loads.

Loads consisting of cartons which are easily crushed may be stretch wrapped with light gauge film under very low tension. Light gauge films are on the market in the range of 60 to 70 gauge but these films cost more per pound. The pre-stretching devices permit the use of lower cost heavy gauge films which may be pre-stretched to make light gauge films which are then wrapped around the load under light tension. For example, a 5000 foot roll of 100 gauge film, if pre-stretched to 100% would yield 10,000 feet of 50 gauge film and wrap twice as many pallet loads which may be adequately wrapped under light tension.

There are several different types of pre-stretching systems. A first type is a non-powered system which relies upon the load pulling the film both off the roll of film and through the pre-stretching device. This system eliminates the requirement for friction brakes but considerable inertia is added to the operation of the system both due to the necessity of pulling the material off of the film roll and due to the need to rotate the rubber rollers which are geared together. In addition, the gears between the rollers must be changed in order to change the percentage of pre-stretching.

A second type of system is a powered system that employs a variable speed motor drive for each of the two rubber rollers plus a friction brake on the film roll. The two motors must attempt to maintain a speed differential under varying film demands which often leads to severe inaccuracies in the extent of pre-stretching. In addition, the friction brake adds inherent erratic behavior toward trying to maintain a constant pre-stretching.

A second type of powered system uses one power driven roll with a friction brake then being coupled to the other roller. The pre-stretching is adjustable by varying the setting of the electromagnetic brake torque of the friction brake.

In all of the above systems, however, there is still the need for additional stretching of the film to take place between the pre-stretching device and the load when actually wrapping the load. This additional stretching during the wrapping operation quite often varies in magnitude due to the uneven shape of the load, which is normally not round. The final result is that each load is still wrapped under a different stretch tension as well be further explained below.

While there are several benefits of pre-stretching, such as outlined above, there are also definite limitations to such procedures. In most stretch wrapping applications, the integrity of the unitized load depends upon the cling of one layer of film to another layer of film. In addition to keeping the tail end of the wrap from unwrapping, film cling is extremely important in spiral wrapping where the "lamination" or overlaying of one layer upon another produces considerable strength in the wrapped load. Many of the stretchable films currently on the market tend to dramatically lose their clinging ability when stretched beyond 100%. Often loads that are stretch wrapped with 120% pre-stretched film have been observed to become unwrapped in 48 hours. Other films will become too brittle and shatter like glass when excessively pre-stretched while yet other films will take a set and lose their load holding power. All films tested have demonstrated a considerable loss in strength in the transverse direction when stretched over 100%.

This inherent limitation in the extent to which it is beneficial to pre-stretch a film prior to wrapping becomes even more critical upon realizing that further variable stretching occurs during the wrapping operation itself. The rotating turntable support member rotates a load which is usually not round. This results in variable demands on the film dispensing mechanism. This becomes a particular problem where the dispensing of stretchable material does not occur at an identical rate with the demand for such material by the rotating load. This is particularly a problem where a pre-stretching device is inserted between the film roll and the load since the roll of film does not roll freely in response to the taking up of film by the load. Inherently this variable demand for film that is not synchronized with the dispensing mechanism produces an erratic tensioning of the film.

As can be seen from FIG. 8 of the drawings, which illustrates a prior art system, with a rectangular load the demand for film will vary greatly as the load is rotated. Assuming that the pallet load size is 40 inches by 60 inches when the film is wrapping the long side of the load, the effective wrapping diameter is 40 inches. At 10 rpm turntable speed, the film is drawn from the roll at 105 fpm. As the corner of the load approaches, the effective wrapping diameter becomes the diagonal dimension of 72 inches. At 10 rpm turntable speed, the film must now accelerate to 188 fpm in less than 1 second, i.e. an 80% increase in speed. Subsequent rotation of the load produces a similar decrease in speed and a series of sudden accelerations and decelerations as the load continues to be wrapped. The film speed curve abruptly changes during the wrapping operation. The inertia and momentum of the film roll constantly opposes the desired results by tightening and slackening film tension during the wrapping cycle which further enhances the degree of variance in tension of the wrapping film. In such a wrapping operation, the film tension at the corners of the load can double with the film brake turned off due entirely to the inertia of the film roll. The peak in film tension occurs just as the sharp corner of the load is presented to the film. Consequently, the tension on the film must be set well below (approximately half) the theoretical limits of the film to prevent breaking of the film.

This problem is further aggravated by the braking systems in common use today. Most of the braking systems employ some variation of a friction brake, usually electro-magnetically controlled. An electromagnetic brake has approximately 300 to 400% more torque at rest (static) than when rotating. This means in connection with the operation of the stretch wrapper that when the film tension drops off suddenly during load rotation, the film roll stops turning momentarily and the brake becomes tightly locked. As the corner of the load swings outwardly (see FIG. 8) the film tension suddenly increases and the friction brake must be jerked into rotation to reduce its braking torque to preset value. This violent action occurs just as a relatively sharp corner of the load comes around and it is one of the major causes of film breakage. This problem becomes even more pronounced with higher speeds of rotation.

SUMMARY OF THE INVENTION

An object of the present invention is to provide an improved stretch wrapping machine and stretch wrapping operation.

Another object of the present invention is to provide a stretch wrapping machine for wrapping a load with a stretchable material while maintaining such material under a substantially constant tension.

A further object of a first embodiment of the present invention is to provide a stretch wrapping machine that includes a pre-stretching device and is capable of wrapping a load with a stretchable wrapping material while maintaining such material under a substantially constant tension during the wrapping operation.

Still another object of the present invention is to provide an improved stretch wrapping machine for enabling the wrapping of a load with a stretchable wrapping material and reducing the possibility of breakage of the material during the wrapping operation due to variations in tension on the stretchable material.

A still further object of the present invention is to provide an improved stretch wrapping machine for more tightly wrapping loads without crushing any portion of the load.

Still another object of the present invention is to provide an improved stretch wrapping machine capable of tightly wrapping irregularly shaped loads while maintaining a substantially constant stretch of the stretchable material.

A still further object of the present invention is to provide a stretch wrapping machine and a wrapping operation that enables the stretchable material to be pre-stretched to a greater extent without subsequently incurring a risk of film breakage during the wrapping operation.

A still further object of the present invention is to provide a stretch wrapping machine and operation that overcome those problems of prior machines discussed above.

Still another object of the first embodiment of the present invention is to provide a stretch wrapping machine that eliminates the need to use troublesome friction brakes and provides a film dispensing system that supplies the stretchable film to the load during the wrapping operation under a substantially constant tension and compensates for speed surges resulting from uneven configuration of the load.

Another object of a second embodiment of the invention is to provide a stretch wrapping machine having a friction break which controls the supply of film while maintaining a relatively constant tension on the film.

The above objectives are accomplished in the utilization of the stretch wrapping machine and stretch wrapping operation of the present invention wherein the stretchable wrapping material is wrapped around the pallet load while maintaining a substantially constant tension on the wrapping material. The constant tension on the wrapping material is maintained by providing a mechanism that in effect isolates the wrapping of the load and the accompanying drawing up of material by the load from the dispensing of the stretchable material from the roll of material. In this manner the tension on the stretchable material can be maintained substantially constant even though the rate at which material is taken up by the load varies due to the varying shape of the load.

In order to stretch the stretchable wrapping film being wrapped around the load, the load is rotated at a speed for drawing up film faster than the film is dispensed. In the preferred embodiment of the present invention, the film can be pre-stretched up to 300% and then further stretched during the wrapping operation to cause a total stretching of 500%.

The pallet load that is to be wrapped by the wrapping machine is placed upon a load support member. The support member then is normally rotated so as to take up the stretchable wrapping material to be wrapped around the load. Alternatively, the dispensing mechanism which holds the stretchable wrapping material can revolve around the load support member so that the load pulls off the stretchable wrapping material as the dispensing mechanism revolves. A drive mechanism provides the relative movement between the dispensing mechanism and the load support member.

A tension maintaining mechanism forming part of the wrapping machine acts to maintain the substantially constant tension on the stretchable material as the material is wrapped around the load. This tension maintaining mechanism applies a biasing force against a tension roller over which the stretchable material passes so as to maintain a constant tension on the stretchable material. The tension roller is movable with respect to the load support member. Thus as the load is rotated, if due to the configuration the load draws up the stretchable material more rapidly then the tension roller moves closer to the load support member so as to maintain the constant tension. Alternatively, as the speed at which the load draws up the stretchable material decreases, the tension roller moves away from the support member so as to pick up any slack that would otherwise occur in the stretchable material and thereby maintain the constant tension in such material.

The tension roller of the tension maintaining mechanism is attached to a pair of arms capable of swinging either towards or away from the support member so in essence the tension roller with the arms act as a "dancer". To understand the operation, returning to prior art FIG. 8, it can be seen that as the corner of the load swings outwardly it suddenly demands more film. In accordance with the present invention to compensate for such demand, the dancer of the tension containing mechanism swings forward so as to dispense surplus film stored in the dancer loop. As the short side of the load comes around thus requiring less film than the dispensing mechanism in supplying, the dancer swings away so as to store the surplus film. The biasing force on the dancer which is constant throughout arcuate swing maintains the same tension on the film in any position of the dancer.

The dispensing mechanism includes a film feed roll for drawing film off the roll of stretchable material at a constant rate thus the film feed roller acts as a governor that simply feeds the stretchable material at a constant rate. In both embodiments, a control device can be incorporated and operated in conjunction with the movement of the dancer so as to sense when the dancer moves too far in either direction. In the first embodiment when such movement of the dancer occurs, the speed of the film feed roller is adjusted by the control device to bring the system back into balance. In the second embodiment when such excess movement of the dancer occurs the braking force which is applied to the film feed roll is varied to bring the system back into balance.

In order to maintain the biasing force on the dancer and hence the tension roller that presses against the stretchable material, a constant force applying mechanism is coupled to the dancer to maintain the constant force as the dancer swings back and forth. Two possible types of mechanisms that can be used for supplying the necessary constant force to the dancer are fluid cylinder having a self-relieving type air regulator and a Neg'ator spring that is marketed by Hunter Spring Company. Both of these mechanisms provide a constant force regardless of displacement. A constant torque electric motor can also be used to produce constant force. If the constant force mechanism biases (or loads) the tension roller with force of 100 lbs. then the tension force on the stretchable material is 50 lbs. on the material extending from each side of the roller. The actual force applied by the fluid cylinder or spring, however would be higher since the length relationship of the linkage members between the tension roller and the force applying mechanism must be taken into consideration.

In the first embodiment, prior to actually wrapping the stretchable material around the load, it is possible to pre-stretch the material. In order to carry out such a pre-stretching operation the material is passed between a first stretching roller and a second stretching roller arranged along the path of travel of the material with the second roller rotating with a greater circumferential speed than the circumferential speed of the first stretching roller. This differential in speed creates a corresponding pre-stretching of the stretchable material. The second stretching roller of the pre-stretching mechanism can be the constant rate feed roller of the dispensing mechanism. Thus the only additional roller is a first stretching roller the speed of which is varied depending upon the extent of pre-stretching desired. In order to ensure that the pre-stretching occurs to the extent desired as determined by the speed differential between the two rollers, spring biased nip rollers can be used to clamp the stretchable material against the stretching rollers to avoid any slippage of the material during the pre-stretching operation.

In conjunction with the utilization of the constant tension mechanism of the present invention, it is possible to employ a horizontal supply mechanism that constitutes another aspect of the invention. The horizontal supply mechanism enables a much larger roll of stretchable wrapping material to be used in conjunction with a wrapping machine particularly a spiral type wrapping machine since the roll does not move up and down with the spiral dispensing carriage. With this type of wrapping machine, the film roll and the feed roller as well as the stretch roller are arranged horizontally in fixed positions so that each rotates about a fixed horizontal axis. The film as it is dispensed from the roll passes over a 45° air bar that turns the film into a vertical position just prior to being supplied to the dancer mechanism with the tension roller. Only the dancer mechanism with the tension roller and the air bar move up and down so as to supply the film to the load in spiral application. This particular mechanism provides two principal benefits. First, the mechanism eliminates the need to move the heavy weight of the film roll, stretch rollers, drive motors, controls and other associated equipment up and down on the vertical cage since all of these remain stationary. Thus a lighter, safer and more economical elevator mechanism can be used. Second, it now becomes practical to use much larger film rolls which more easily can be mounted horizontally for most packaging machines particularly on automatic machines thereby enabling, for example, up to four times as many pallet loads to be wrapped without stopping the machine or changing the rolls.

DESCRIPTION OF THE PREFERRED EMBODIMENTS

Figure 1:
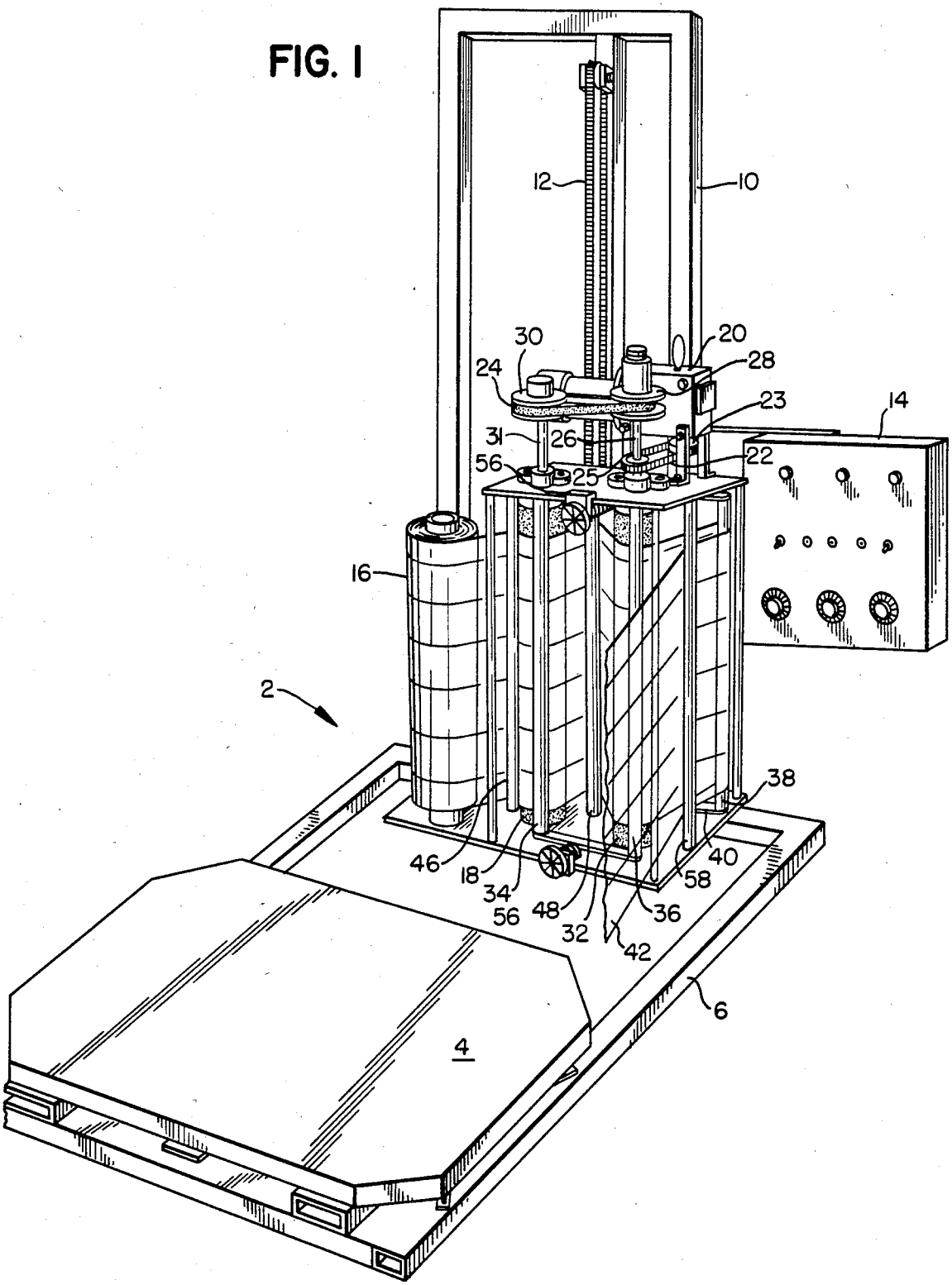
FIG. 1 is a perspective view of one embodiment of a stretch wrapping machine in accordance with the present invention.

A stretch wrapping machine 2 such as illustrated in FIG. 1 has a rotatable load support turntable 4 and a dispensing mechanism 8 both arranged on a support frame 6. Turntable 4 is capable of rotating around a central axis so that it draws off stretchable wrapping material (often referred to as film), from the dispensing mechanism with the supply roll 16.

The particular stretch wrapping machine illustrated in FIG. 1 is a spiral type wrapping machine in which the width of the wrapping material is less than the height of the load that is to be wrapped. In the operation of the spiral wrapping machine during the wrapping operation, dispensing mechanism 8 moves up and down carriage 10 as turntable 4 rotates the load to be wrapped. In this manner the load is wrapped with a plurality of overlapping wraps as the dispensing mechanism moves up and down on the carriage. This movement of the dispensing mechanism is controlled by movement of drive chain 12 which can be driven in either direction for moving dispensing mechanism 8 which is coupled to the drive chain.

Dispensing mechanism 8 includes a supply roll of the stretchable wrapping material 16 which first passes around a first roller 18 and subsequently over a feed roller 32 before being supplied to the constant tension mechanism. A motor drive 20 drives feed roller 32 which in turn drives roller 18. Alternatively motor drive 20 can be directly coupled to roller 18 and then feed roller 32 would be coupled to and driven by roller 18.

The output gear (sprocket) 23 of motor drive 20 is coupled to gear (sprocket) 25 and transfer drive shaft 26 through a drive chain 22. Transfer shaft 26 in turn rotates pulley 28 which through drive belt 24 rotates pulley 30. By properly sizing the portions over which drive belt 24 passes around pulleys 28 and 30, a desired rotating relationship between the two pulleys and hence rollers 18 and 32 can be obtained. A variable speed drive mechansim can be used between shaft 26 and shaft 31. Rotation of pulley 30 through shaft 31 rotates roller 18 at a speed having a desired relationship to the speed of roller 32.

The speed at which feed roller 32 rotates should remain at a relatively constant set level for supplying the stretchable material to the tension mechanism at a constant rate during a wrapping operation. The speed of feed roller 32 can vary under certain circumstances during a wrapping operation, however, the speed of rotation of feed roller 32 can be varied by varying the output speed of motor drive 20. This speed of rotation is controlled through control mechanism 14, which is also capable of controlling other various aspects of the operation of the stretch wrapper such as the number of wraps to be made around the load and the height to which the dispensing mechanism should travel in wrapping the load.

Figure 4:
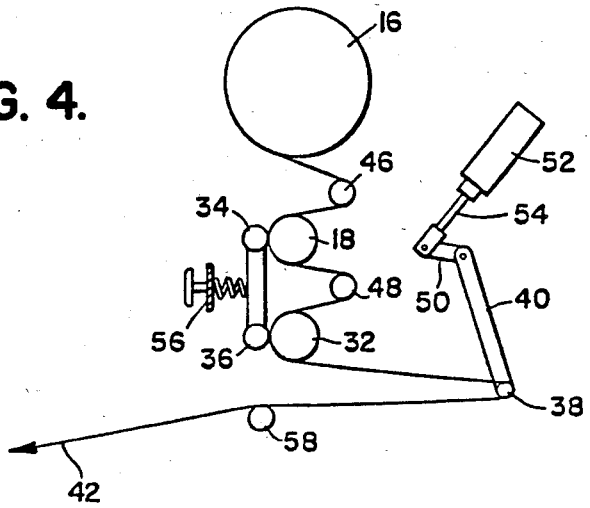
FIG. 4 is a diagrammatic view of the stretch wrapping machine illustrated in FIG. 1.
Figure 5:
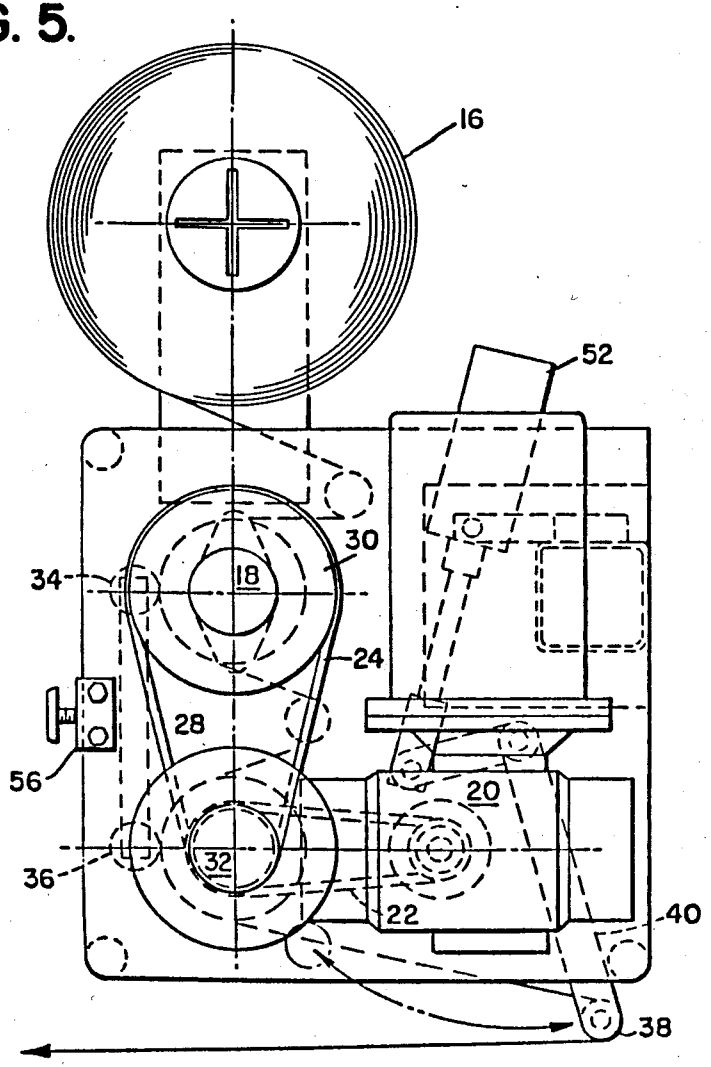
FIG. 5 is a top plan view of the dispensing mechanism of the stretch wrapping machine illustrated in FIG. 1.

Gear 25 and transfer shaft 26 act as the coupling for driving roller 18 and also drives feed roller 32. Due to the difference in sizes of pulleys 28 and 30, as shown in FIG. 1, as well as in FIG. 5, feed roller 32 will rotate at a much faster speed than roller 18. The ratio of the speed of rotation of the circumferential surface of feed roller 32 as compared to roller 18 determines the extent of pre-stretching that will occur. If there is no slippage between the wrapping material and rollers 18 and 32, then the extent of pre-stretching is directly proportional to the speed differential between the two rollers. In order to prevent any slippage, both roller 18 and feed roller 32 are covered with a rubber material for firmly grasping the stretchable material as it passes around the roller. In addition, nip rollers 34 and 36 which are spring biased by mechanism 56 as shown in FIGS. 4 and 5 press the nip rollers for clamping the stretchable material against rollers 18 and 32 as the rollers rotate so as to avoid any slippage of the stretchable material.

Figure 2:
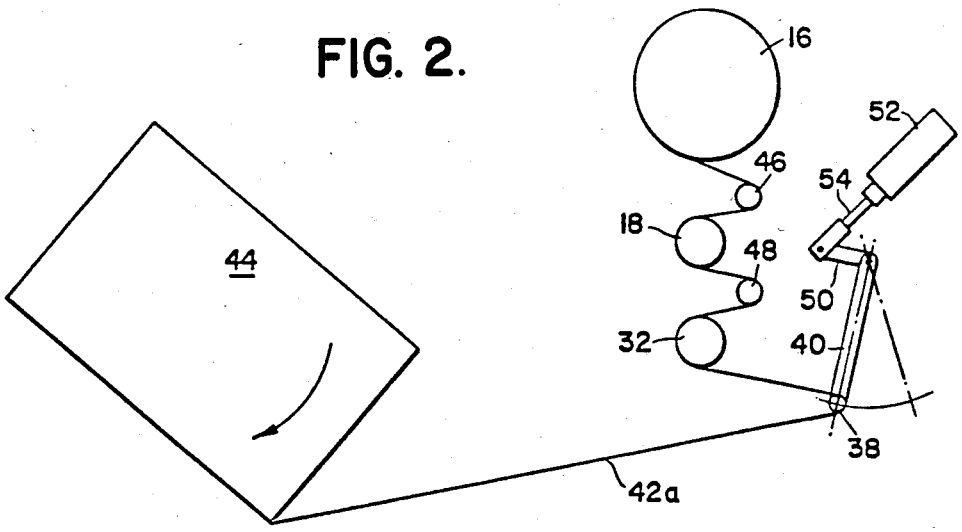
FIG. 2 is a diagrammatic view illustrating the operation of the stretch wrapping machine of FIG. 1.
Figure 3:
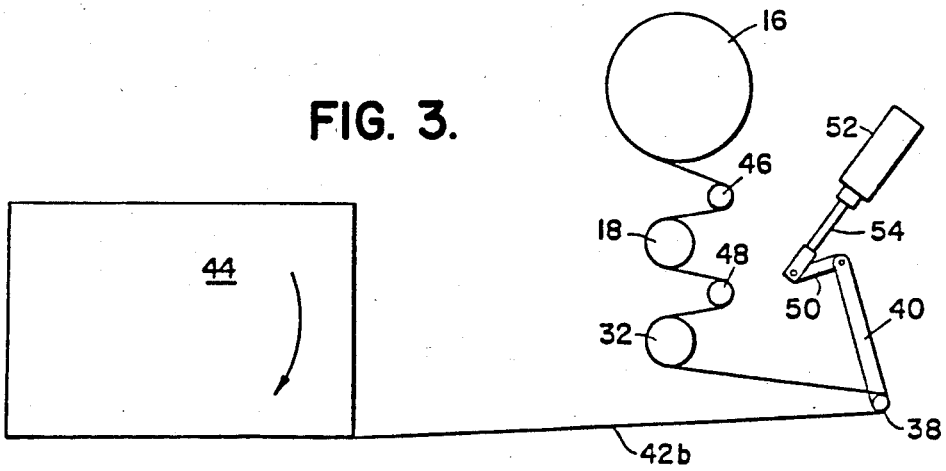
FIG. 3 is another diagrammatic view similar to FIG. 2 illustrating the stretch wrapping machine during another stage of the wrapping operation.
Figure 8:
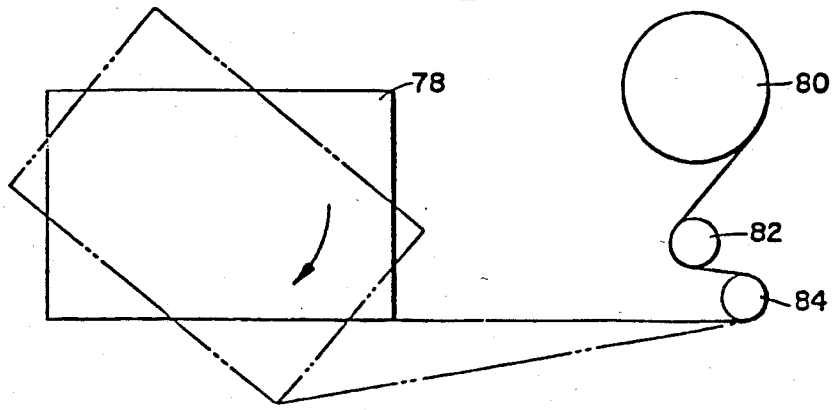
FIG. 8 PRIOR ART
FIG. 8 is a diagrammatic view of a stretch wrapping machine in accordance with the prior art.

The operation of the constant tension mechanism can be seen and is explained herein in conjunction with the diagrammatical illustrations in FIGS. 2 and 3 as well as comparison with the prior art system as illustrated in FIG. 8. As shown in FIG. 8, as load 78 rotates the speed at which the load rotates will vary. This can be seen by observing the difference in the length of the stretchable material between roller 84 and load 78 between the load positioned as shown by the solid lines and the load positioned as shown by the broken lines. If roller 80 is power driven or rollers 82 and 84 are power driven so that the quantity of material passing around roller 84 is relatively constant during the wrapping operation then the variance in the demand for film by rotating load 78 will increase the tension on the film thereby causing significant variations in the amount of stretching of the film during the wrapping operation. Even if the machine as shown in FIG. 8 supplies the film completely based upon the pulling of the material by rotating load 78, due to the inertia in pulling the various rollers the tension on the wrapping material still will vary.

In the wrapping machine and operation of the present invention, however, this variance in the demand for wrapping material by the rotating load 44 is compensated for by the constant tension mechanism so as to maintain a constant tension on the section of stretchable wrapping material **42*a* and 42*b* being supplied to and wrapped around load 44 as it rotates. As shown in FIG. 2, as load 44 rotates to a position where the speed at which the load draws up the stretchable wrapping material increases, tension roller 38 moves closer to the load by pivoting movement of dancer arms 40. As tension roller 38 moves closer, it supplies the extra material needed while the tension force that pulls upon the portion of wrapping material 42*a*** extending to the load is maintained at a substantially constant level.

Dancer arms 40 on which roller 38 is mounted are connected to an air cylinder 52, having a self-relieving type air regulator, through a linkage arm 50 and piston rod 54. The linkage arm 50 is connected to arm 40. There can be either a single air cylinder or two cylinders, one at the top and one at the bottom. With air cylinder 52, a constant biasing force is applied to tension roller 38 for biasing such roller away from load 44 with a substantially constant force irrespective of the position of tension roller 38 and the extent to which piston rod 54 extends from air cylinder 52. Thus whether the load 44 is in the position shown in FIG. 2 or the position shown in FIG. 3 the tension on the portion of wrapping material extending to the load, **42*a* and 42*b*, respectively, is maintained at a substantially constant level. In this manner, the additional stretching of the stretchable material that takes place during the actual wrapping of the load can be maintained at a substantially constant percentage. While the tension is maintained constant during a wrapping operation, the tension can be varied from one operation to the next by regulating or adjusting the air pressure to the air regulator of the air cylinder itself or the air cylinder position with respect to tension roller 38**.

The stretching during the wrapping operation is separate from the pre-stretching that occurs prior to the material passing around tension roller 38. As described above, pre-stretching of the stretchable material occurs between roller 18, which acts as a first stretching roller, and feed roller 32, which acts as the second stretch roller. To help avoid breakge in and necking down of the stretchable material during the pre-stretch operation, the stretchable material also can pass over an idler roller 48. Idler roller 46 improves the wrap around roller 18.

During the wrapping operation it is desirable to keep the geometrical angle of the film as it approaches tension roller 38 and as it leaves the tension roller substantially the same. Variations in such angles have been noted to have a negative impact upon the tension in the film thereby causing undesirable variations in the stretching of the film during the wrapping operation. For this purpose, an additional idler roller 58 can be inserted along the path of the stretchable wrapping material as it leaves tension roller 38 such as shown in FIG. 4. Roller 58 rotates about a fixed axis and hence the angle of the film approaching tension roller 38 and the film leaving tension roller 38 remains substantially the same.

Figure 6:
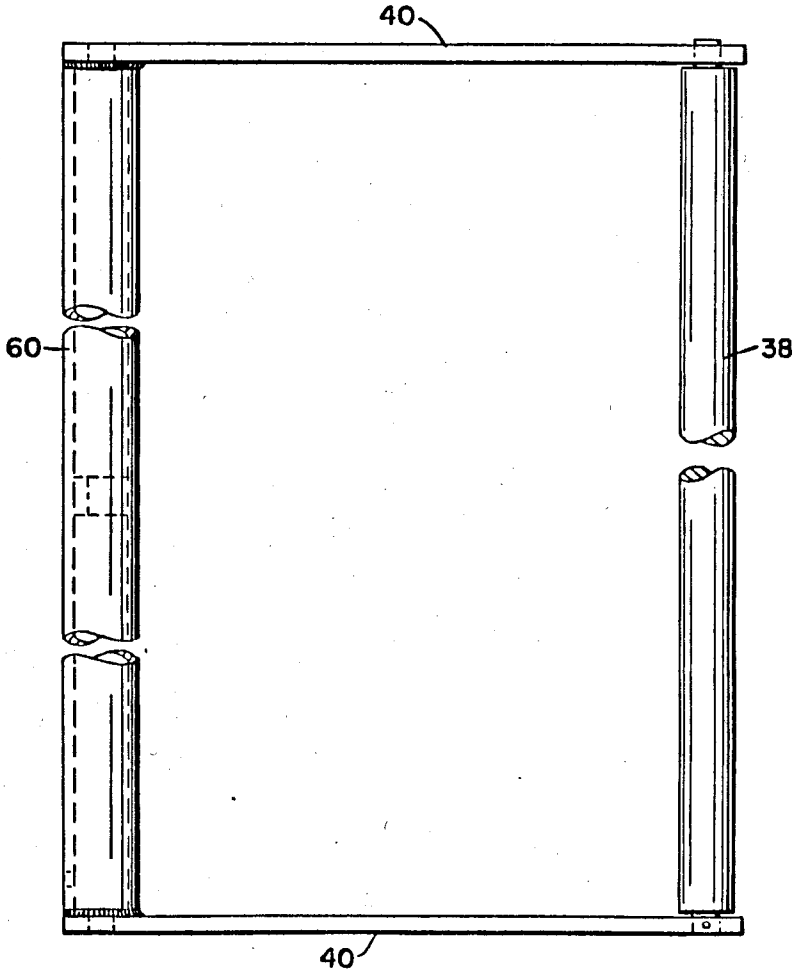
FIG. 6 is a front plan view of the dancer mechanism and tension roller used in the stretch wrapping machine illustrated in FIG. 1.

Tension roller 38 is connected to a pair of dancer arms 40 at both ends of the roller such as shown in FIG. 6. The two arms are then connected to rod 60 which in turn is coupled to self-relieving air cylinder 52 through linkage member 50 and piston 54.

Figure 7:
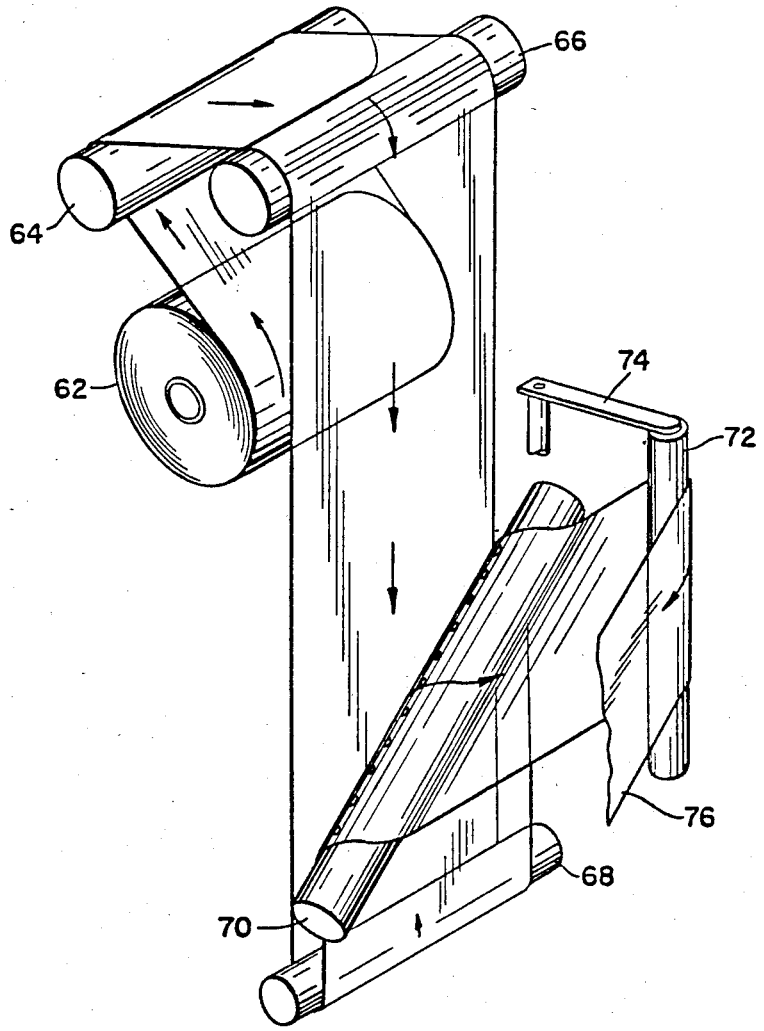
FIG. 7 is a perspective diagrammatic view of another embodiment of the stretch wrapping machine of the present invention.

In a modified embodiment of the stretch wrapper of the present invention, such as shown in FIG. 7, a role of stretchable wrapping material 62 is arranged along a horizontal axis. The stretchable material as it leaves roll 62 passes over a feed roller 66 which is driven in the same manner as feed roller 32 as discussed above in connection with the embodiment of FIG. 1. The stretchable material also can pass over an intermediate roller 64 that serves as a stretch roller by being at a slower speed than roller 66 for pre-stretching the stretchable wrapping material. By rotating roller 66 at a greater circumferential speed than roller 64, prestretching of the stretchable wrapping material can be obtained. The stretchable wrapping material then passes around an idler roller 68 still traveling along a vertical path and subsequenty is rotated by 90° as it passes around air bar 70. Air bar 70 has a plurality of openings out of which air passes so as to enable a smooth flow of the stretchable material around the air bar as the material is turned. Air bar 70 is arranged so as to extend at a 45° angle with respect to idler roller 68 so that it can properly rotate the stretchable wrapping material. The stretchable wrapping material then passes around tension roller 72 that is connected to dancer arms 74. The portion of the stretchable wrapping material 76 passing around tension roller 72 is then fed to the load for being wrapped around the load as discussed above in conjunction with the embodiments shown in FIG. 1. During a spiral wrapping operation the only elements that would move up and down along carriage 10 in the embodiments shown in FIG. 7 would be air bar 70 and the tension maintaining mechanism that includes tension roller 72 and dancer arms 74.

Figure 9:
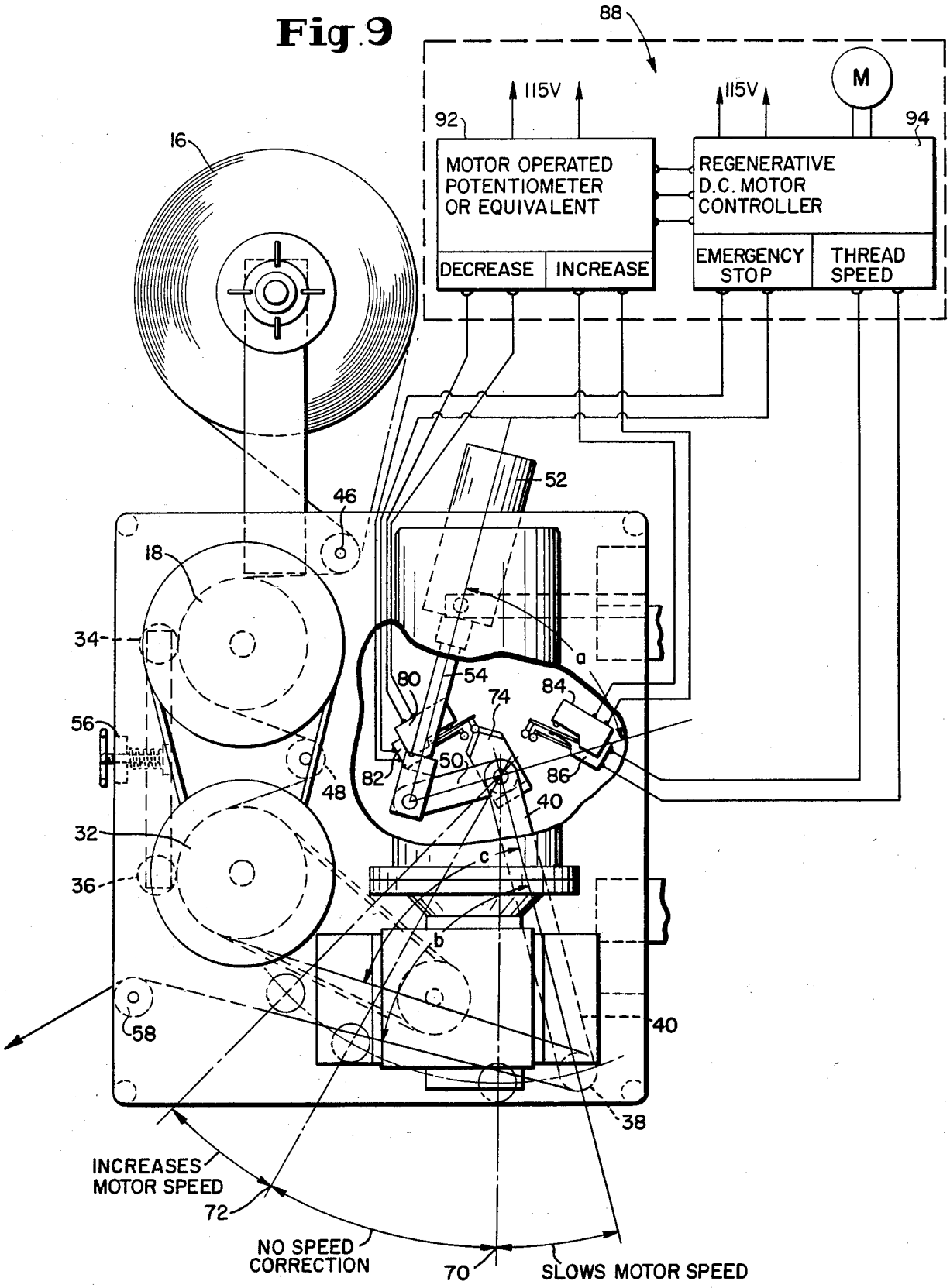
FIG. 9 is a top view of the preferred form of the first embodiment which includes a motor control mechanism for the stretch rollers.

FIG. 9 illustrates a form of the first embodiment of the invention which controls the speed of the rollers 18 and 32 (not the relative speed between the rollers) in response to movement of the dancer arms 40. In FIG. 9, the angles "a", "b" and "c" are substantially equal to each other within the path of rotation defined by the arcuate segments labeled "INCREASES MOTOR SPEED, NO SPEED CORRECTION, and SLOWS MOTOR SPEED". When these angles are substantially equal, the wrapping tension is maintained substantially constant. The roller 32 of the prestretcher and the tension roller 38 define a path of approach of the stretchable wrapping material and the tension roller 38 and the roller 58 define a path of departure of the stretchable wrapping material. The linkage arm 50 is connected to arm 40. It has been found that the control of the speed of the rollers 18 and 32 in response to movement of the dancer arms 40 past angular limits 70 and 72 to increase the speed of the rollers in response to an increase in the velocity of the wrapping material at the load support and to decrease the speed of the rollers in response to a decrease in the velocity of the wrapping material at the load support helps prevent breakage of the wrapping material. Identical reference numerals are used in FIGS. 1–8 and 9 to identify like parts. In addition to the constant tension mechanism described supra with regard to FIGS. 2 and 3, the form of the first embodiment illustrated in FIG. 9 includes means for varying the velocity of the first roller 18 and feed roller 32 when the dancer arms 40 rotate past angular limits of 70 and 72. The means for varying the velocity of the rollers 18 and 32 includes a cam 74 which is fixedly mounted to the end of dancer arms 40. The rotation of the cam 74, which is produced by rotation of dancer arms 40, closes microswitches 80, 82, 84 and 86 as described, infra. The contact of microswitch 80 is closed when the dancer arms 40 rotate counter-clockwise past the angular limit 70 and the contact of microswitch 82 is closed if and when the film breaks. The closure of contact 80 activates a motor control mechanism 88 described infra to slow down the rotation of rollers 18 and 32 to reduce the supply of film to ultimately cause the dancer arms 40 to rotate back clockwise past angular limit 70 where no motor speed control is utilized. If the film breaks, the contact of microswitch 82 closes and causes activation of an emergency stop dynamic braking circuit which stops the motor instantaneously which drives the rollers 18 and 32. The contact of microswitch 84 is closed first when the dancer arms 40 rotate clockwise past angular limit 72 and the contact of microswitch 86 is closed manually when the dancer arms 40 are pushed against the resistance of a spring (not illustrated) to run the rollers 18 and 32 at a slow speed used only during threading of the film. The closure of the contact of microswitch 84 activates the motor control mechanism 88 described infra to speed up rollers 18 and 32 to increase the supply of film to cause dancer arms 40 to ultimately rotate counter-clockwise back past angular limit 72. When the tension roller 38 is located between angular limits 70 and 72, the motor control 88 does not cause any change in the driven velocity of stretch wrapping material passing through the prestretcher. The stretch wrapping material accumulated between the roller 32 of the prestretcher, tension roller 38 and the idler roller 58 supplies the demand for additional stretch wrapping material caused by the wrapping of a corner of a load. Additonally, the tension roller 38 biased by air cylinder 52 takes up surplus stretch wrapping material during the wrapping of a load when the demand for stretch wrapping material is decreasing. The closure of the contact of microswitch 86 only occurs manually during threading of the film when the dancer arms are pushed by an operator against the aforementioned spring bias which opposes its closure. The motor control 88 includes a motor operated potentiometer (MOP) or equivalent electronic potentiometer 92 which may be a model SS MOP-1 manufactured by Precision D Series Inc., 63 Nicholas Road of Framingham, Mass. and a regenerative DC motor controller 94 which may be a model RG 8 manufactured by Southcon of 3608 Rozzells Ferry Road, Charlotte, N.C. The output of the regenerative DC motor controller 94 is applied to motor 96 which is applied to drive 20 of FIG. 1 to vary its speed. The function of the regenerative DC motor controller 94 is to maintain the output shaft speed of the motor 94 constant independent of torque. The DC motor controlled by a regenerative controller functions as a brake to the load when the motor is being driven by the load at a speed higher than the rated speed of the controller for driving a load. The function of the motor operated potentiometer 92 or the equivalent is, upon the closure of the contacts of microswitches 80 and 84, to respectively increase and decrease the motor drive velocity for the rollers 18 and 32. The output signal which is applied from the motor operated potentiometer 92 to the regenerative DC motor controller 94 is maintained at a constant potential upon the subsequent opening of the contacts of microswitches 80 and 84, which potential is maintained equal to the potential at the instance of opening of the contacts.

Figure 10:
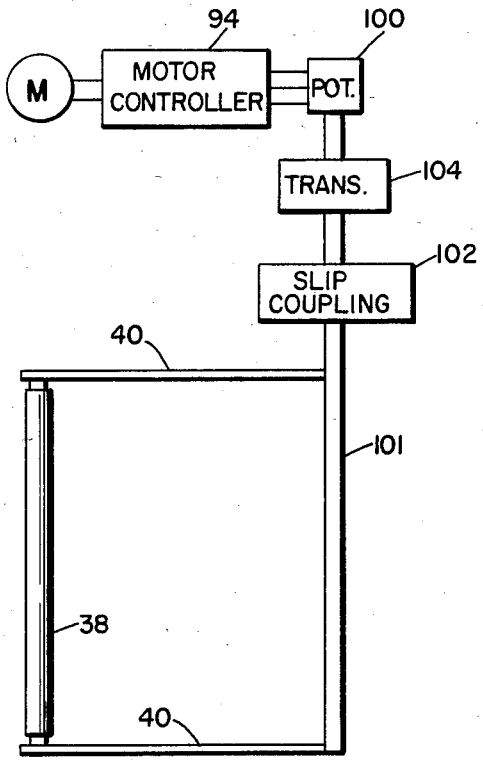
FIG. 10 is an elevational view of a modification of the embodiment of FIG. 9.

FIG. 10 illustrates schematically a second form of motor control for the rollers 18 and 32 which is proportionate to the angular position of the dancer arms 40 throughout almost the entire rotation of the dancer arms 40. In this form of motor control, a potentiometer 100 is coupled to the axis of rotation 101 of the dancer arms 40 by a slip coupling 102 and a transmission 104 which multiplies the angular rotation of the dancer arms (approximately 60°) into 300° of rotation to use the full range of commercially available rotary potentiometers. The slip coupling 102, which may be of any known design, allows for a limited degree of dead space between initial movement of the axis of rotation 101 of the dancer arms 40 and the wiper of the potentiomeer 100. The potentiometer 100 functions as a means for detecting change in the velocity of the wrapping on the load. The dead space tends to prevent over compensation of the velocity of the rollers 18 and 32 which could cause "hunting" by not introducing a change in the motor control until a change in the sign (positive to negative or visa versa) of the acceleration of the film has occurred which has produced a net velocity change of a magnitude sufficient to require correction. With reference to FIG. 10, the motor control potentiometer circuit has potentiometer 100 which is electrically coupled to a regenerative DC motor controller 94 which may be identical to the regenerative DC motor controller described supra with regard to FIG. 9. The motor controller maintains the speed of the motor substantially constant.

Figure 11:
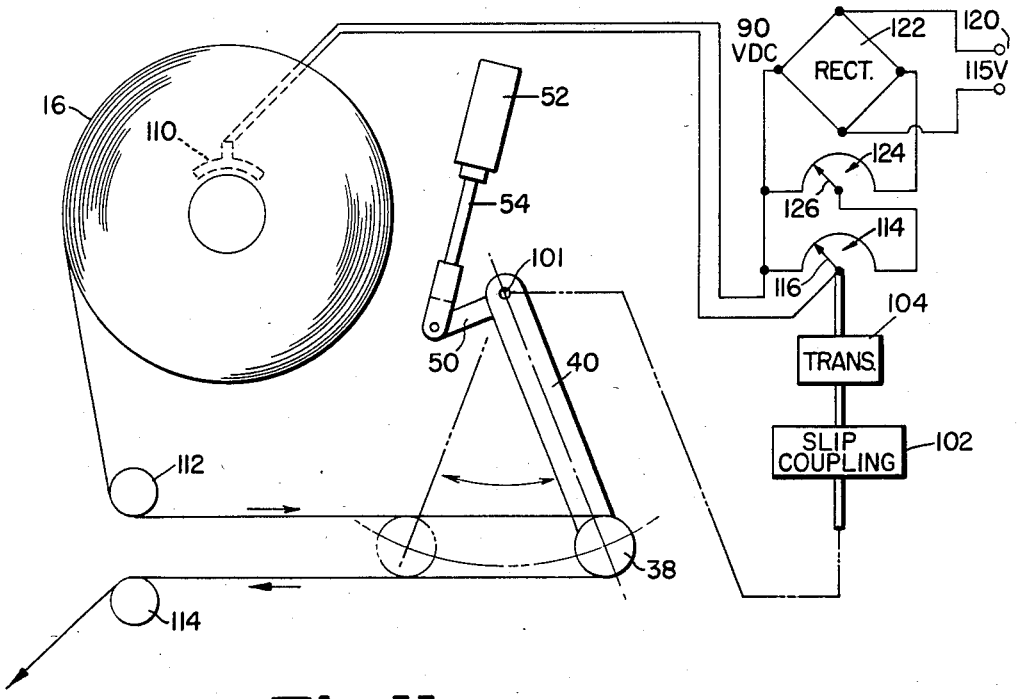
FIG. 11 is a view of a second embodiment of the invention.

FIG. 11 illustrates a second embodiment of the invention which does not prestretch the film before wrapping. The same reference numerals are used in FIGS. 10 and 11 to identify like parts. The second embodiment differs principally from the first embodiment in that the film of wrapping material 16 is pulled from the film roll by the rotation of the load not illustrated which is resting on a turntable under the resistance of braking force which is applied by a film roll electromagnetic brake 110. The preferred form of brake is the magnetic particle type. Once the film 16 leaves the film roll, it contacts idler roller 112, and a constant tension mechanism, including elements 38, 40, 50, 52 and 54, which is identical to the constant tension mechanism described above with reference to the first embodiment. The film passes from roller 38 to idler roller 114 and to a load being wrapped which is not illustrated. The wiper 116 of a rheostat 114 is connected to the axis of rotation of the dancer arms 40 by a slip coupling 102 and transmission 104 which are identical to those described with reference to FIG. 10 supra. The rheostat functions as means for sensing changes in the velocity of the film being wrapped on the load and produces an output voltage which is a linear function of the velocity of the film. The position of the wiper 116 of the rheostat 114 is used to generate a signal to control the braking force applied to the film roll by the electromagnetic brake 110. The control circuit of FIG. 11 includes a source of alternating current potential 120. The alternating current is rectified by a full wave rectifier 122 which output is applied across the terminals of master control rheostat 124. The setting of the wiper 126 of the rheostat 124 determines the average braking force which is applied by the electromagnetic brake 110. The greater the resistance setting of the wiper 126, the greater average braking force which is applied by the electromagnetic brake 100. The wiper 126 is coupled to one of the two terminals of rheostat 116 which is coupled to the axis of rotation 101 of the dancer arms 40 as previously described. The remaining terminal of rheostat 114 is coupled across one of the outputs of full wave rectifier 122 which is in common with the terminal of rheostat 124. The wiper 116 of rheostat 114 is coupled to one terminal of the electromagnetic brake 110, the remaining terminal being coupled to the common terminal of the full wave rectifier 122 and the rheostats 114 and 124. As is apparent from the discussion above with reference to FIG. 10, the angular movement of wiper 116 is responsive to the movement of the dancer 40 in the manner described with reference to slip coupling 102 and transmission 104. The magnitude of the potential which is applied from the full wave rectifier 122 to the electromagnetic brake is a linear function of the combined settings of the wiper arms 103 and 112.

The operation of the electromagnetic brake control in varying the speed of rotation of the film roll is as follows. The constant tension mechanism is adjusted to create the desired tension required for wrapping of an article, the actual wrapping tension being approximately one half of the constant biasing force which has been set on roller 38. After the desired tension is set and the film has been threaded around the article to be wrapped, the master control rheostat 124 is set so that the dancer arms will move in response to changes in velocity of the wrapping film for the desired tension setting. In operation, any significant change in the velocity of the film will produce a counteracting braking force on the electromagnetic brake 100 which tends to maintain a constant tension. If the sign of the (positive to negative or visa versa) acceleration of the film changes, the slip coupling 102 will not translate any movement of the dancer arm's axis of rotation 101 to the wiper 116 of rheostat 114 until a certain magnitude of velocity change has occurred, the dead space in the slip coupling tending to reduce overcorrection in braking force which could result in hunting.

While the invention has been described in terms of its preferred embodiments, it should be understood that numerous modifications may be made to the invention without departing from its scope as defined in the appended claims.

What is claimed is:

1. A constant tension stretch wrapping machine for wrapping a load comprising:

a dispensing means for dispensing stretchable wrapping material;

a turntable for supporting and rotating the load to be wrapped;

a tension maintaining means disposed between the dispensing means and the turntable, said tension maintaining means including;

a first arm pivotably mounted for rotation around a fixed point through a path of rotation;

a first roller rotatably mounted on the first arm at a point offset from the fixed point, the first roller engaging the stretchable wrapping material to define a path of approach of the stretchable wrapping material between the dispensing means and the first roller;

a second roller rotatably mounted at a point between the first roller and the turntable which engages the stretchable wrapping material during wrapping of the load and which defines a path of departure of the stretchable wrapping material between the first roller and the second roller;

the first arm defining a first angle with the path of approach of the stretchable wrapping material and a second angle with the path of departure of the stretchable wrapping material, the first and second angles being substantially equal within the path of rotation and varying with rotation of the arm through the path of rotation;

a second arm pivoted about the fixed point and connected to the first arm; and means for applying a constant force to the second arm at a point offset from the pivot point which opposes a force applied to the first arm by tension on the wrapping material in the paths of approach and departure, the second arm and the means for applying a constant force defining a third angle which is substantially equal to the first and second angles within the path of rotation of the first arm.

2. A constant tension stretch wrapping machine in accordance with claim 1 wherein the first arm has a longitudinal axis which is not parallel with a longitudinal axis of the second arm.

3. A constant tension stretch wrapping machine in accordance with claim 1 further comprising:

means for sensing an increase in the velocity of the stretchable wrapping material being wrapped around the load;

means for sensing a decrease in the velocity of the stretchable wrapping material being wrapped around the load; and control means coupled to the dispensing means which is responsive to the means for sensing an increase in the velocity of the stretchable wrapping material to cause the dispensing means to increase the velocity of stretchable wrapping material being dispensed and which is responsive to the means for sensing a decrease in the velocity of the stretchable wrapping to cause the dispensing means to decrease the velocity of stretchable wrapping material being dispensed.

4. A constant tension stretch wrapping machine in accordance with claim 1 further comprising:

means for sensing when the first arm moves past a first angular limit at a boundary of a first control zone into a second control zone within the path of rotation that is caused by an increase in the velocity of the stretchable wrapping material being wrapped around the load;

means for sensing when the first arm moves past a second angular limit at a boundary of the first control zone into a third control zone within the path of rotation that is caused by a decrease in the velocity of the stretchable wrapping material being wrapped around the load; and control means coupled to the dispensing means for causing the dispensing means to increase the velocity of the stretchable wrapping material fed by the dispensing means in response to the means for sensing when the first arm moves past the first angular limit into the second control zone, for causing the dispensing means to decrease the velocity of the stretchable wrapping material fed by the dispensing means in response to the means for sensing when the first arm moves past the second angular limit into the third control zone and for causing the dispensing means to maintain a substantially constant velocity of the stretchable wrapping material as long as the first arm is within the first zone.

5. A constant tension stretch wrapping machine in accordance with claim 4 wherein the dispensing means feeds the stretchable wrapping material with an increasing velocity as long as the first arm is within the second control zone and feeds the stretchable wrapping material with a decreasing velocity as long as the first arm is within the third control zone.

6. A constant tension stretch wrapping machine in accordance with claim 4 wherein the dispensing means includes means for prestretching the stretchable wrapping material.

7. A constant tension stretch wrapping machine in accordance with claim 6 wherein the means for prestretching includes a motor driven by a regenerative controller with the motor causing the stretchable wrapping material to be fed by the dispensing means.

8. A constant tension stretch wrapping machine in accordance with claim 3 wherein the dispensing means includes means for prestretching the stretchable wrapping material.

9. A constant tension stretch wrapping machine in accordance with claim 8 wherein the means for prestretching includes a motor driven by a regenerative controller with the motor causing the stretchable wrapping material to be fed by the dispensing means.

* * * * *